US007703500B2

(12) United States Patent
Wen et al.

(10) Patent No.: US 7,703,500 B2
(45) Date of Patent: Apr. 27, 2010

(54) BRACKET AND HEAD RAIL ASSEMBLY

(75) Inventors: Yu-Che Wen, Taoyuan County (TW); Chih-Yao Chang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 563 days.

(21) Appl. No.: 11/605,326

(22) Filed: Nov. 29, 2006

(65) Prior Publication Data

US 2008/0121768 A1 May 29, 2008

(51) Int. Cl.
*A47H 5/00* (2006.01)

(52) U.S. Cl. ..... 160/84.05; 160/84.04; 160/173 R; 160/178.1 R; 160/902; 248/254; 248/262; 248/264; 248/252

(58) Field of Classification Search ..... 160/84.04, 160/84.05, 173 R, 178.1 R, 902; 248/252, 248/254, 262, 264, 225.11, 200.1
See application file for complete search history.

(56) References Cited

U.S. PATENT DOCUMENTS 3,916,477 A * 11/1975 Baker, Sr. ..... 16/94 D
3,927,437 A * 12/1975 Ford ..... 16/94 R
4,938,443 A * 7/1990 Rowe ..... 248/251
4,949,926 A * 8/1990 Liu ..... 248/251
5,121,893 A * 6/1992 King et al. ..... 248/251
5,180,130 A * 1/1993 McMichael ..... 248/251
5,186,426 A * 2/1993 Wada ..... 248/251
5,195,570 A * 3/1993 Marocco ..... 160/178.1 R
5,421,551 A * 6/1995 LeClaire ..... 248/257
5,873,385 A * 2/1999 Bloom et al. ..... 137/543.19
6,293,330 B1 * 9/2001 Ciuca ..... 160/176.1 R
6,561,475 B1 * 5/2003 Chuang ..... 248/264
6,899,156 B2 * 5/2005 Tyner ..... 160/178.1 R
7,302,738 B2 * 12/2007 Nien et al. ..... 24/115 F
2001/0007344 A1 * 7/2001 Carter ..... 248/251
2006/0016946 A1 * 1/2006 Bohlen ..... 248/231.9

* cited by examiner

*Primary Examiner*—Katherine W Mitchell
*Assistant Examiner*—Philip S Kwon
(74) *Attorney, Agent, or Firm*—Birch, Stewart, Kolasch & Birch, LLP

(57) ABSTRACT

A bracket and head rail assembly is provided. A recess is formed at both ends of the upper portion of a head rail. The recess is sunken at both sides to form a first slot and a second slot. The bracket includes a body and a fastener, wherein a claw is extended from the body, and an elastic part is extended from the fastener and bears against the body, such that the fastener is slidably disposed in the body. When being assembled, the first and second slots are easily locked with the claw and the fastener, and alternatively, they are exchanged with each other for locking with the claw and the fastener respectively. Then, the head rail and the fastener are designed into a thin configuration, and then, formed by bending and processing sheets, so as to achieve the advantages of simple assembly, mass production, and nice appearance.

8 Claims, 6 Drawing Sheets

BRACKET AND HEAD RAIL ASSEMBLY

BACKGROUND OF THE INVENTION

1. Field of Invention

The present invention relates to a combination structure of a head rail and a bracket, and more particularly, to a structure with the head rail being bi-directionally locked by the bracket, which is easily assembled.

2. Related Art

A blind or shade can provide a protection for the privacy directed to an opened window. Therefore, the structure of the blind or shade is continuously improved. For example, U.S. Pat. No. 6,293,330 discloses a universal head rail assembly, which comprises a head rail and a universal mounting bracket. The head rail comprises a front wall and a back wall, wherein the front wall and the back wall have a first lip and a second lip formed on one end respectively. The universal mounting bracket comprises a mounting assembly and an interlocking element, wherein the mounting assembly has a notch on one side. When the head rail is to be mounted on the universal mounting bracket, the head rail bears against the interlocking element at the second lip, and then, the interlocking element is compressed to slide relative to the mounting assembly, so as to position the head rail. Then, the interlocking element is released, such that the first lip bears against the notch, and the head rail is locked in the universal mounting bracket. Furthermore, the head rail may be bi-directionally locked in the universal mounting bracket, such that two side walls of the head rail may be adjusted depending upon the assembling requirements.

However, as for the head rail and the mounting bracket assembly disclosed in U.S. Pat. No. 6,293,330, the first and second lips of the head rail are disposed into the head rail, such that the head rail is too high. Furthermore, in the universal mounting bracket structure, the interlocking element is slightly inverted-U shape and it is elastic. Such design also causes the interlocking element to have a large volume, thus, the volume occupied by the assembly is accordingly too large.

SUMMARY OF THE INVENTION

In view of the above, the present invention provides a bracket and head rail assembly, wherein a bracket has a simple structure and a head rail has a small height, and furthermore, the head rail is locked in the bracket in dual directions, such that both two side surfaces of the head rail may be served as the front side of the assembly, thus achieving diversified assembling modes.

Therefore, the present invention discloses a bracket and head rail assembly, which comprises a head rail and a bracket. The bracket comprises a body and a fastener, wherein a claw is extended from one side of the body, and the fastener is slidably disposed in the body. An elastic part is extended from one side of the fastener to bear against the body, and a stopper is extended from the other side. When the elastic part is compressed, the fastener slides relative to the body. A recess is formed in the upper portion of the head rail, and the recess is sunken in both sides to form a first slot and a second slot, and a cavity is formed at the lower surface. When the head rail is mounted to the bracket, the second slot is selected to bear against the stopper and the first slot is selected to bear against the claw, or the first slot is selected to bear against the stopper and the second slot is selected to bear against the claw, such that different exteriors or curve designs of two side surfaces of the head rail may be achieved through different assembling modes.

To sum up, as for the bracket and head rail assembly provided by the present invention, since a track-shaped gripping part is formed on one side surface of the head rail to grip with the bracket, the structure of the head rail is simplified and designed into a thin configuration. Therefore, when the head rail is mounted to the bracket, the head rail is gripped into the bracket in any direction, and the different exteriors or curve designs of different side surfaces of the head rail provides diversified assembling selections. The body and the fastener of the bracket are integrated into one piece and formed by bending and processing, and both are simply assembled and designed into a thin configuration, thus, the simple structure of the bracket further reduces the manufacturing and assembly costs.

The features and practice of the present invention are illustrated below in detail through preferred embodiments and with reference to the drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

Figure 1A:
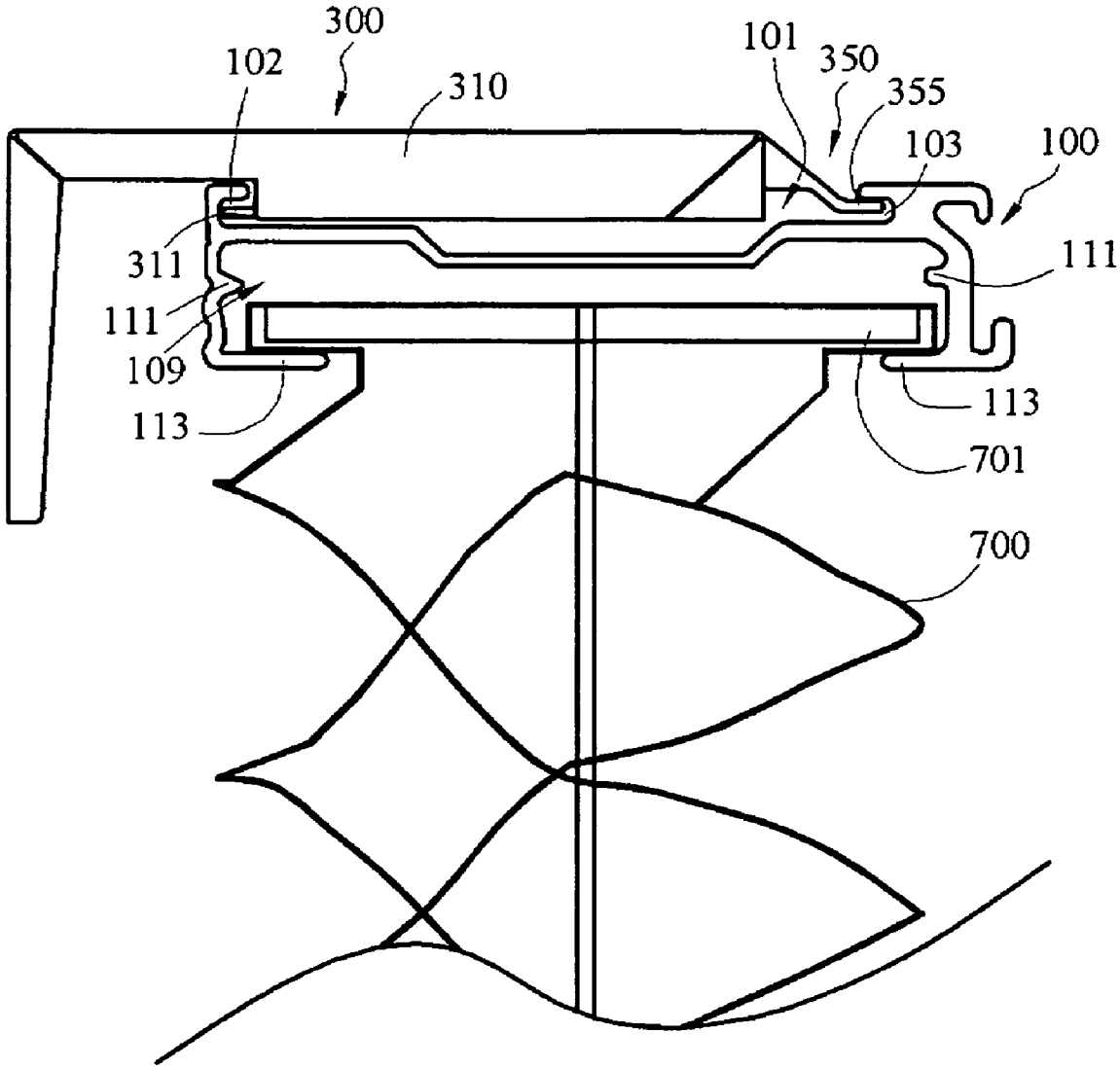
FIGS. 1A and 1B are schematic assembled views of the present invention.
Figure 1B:
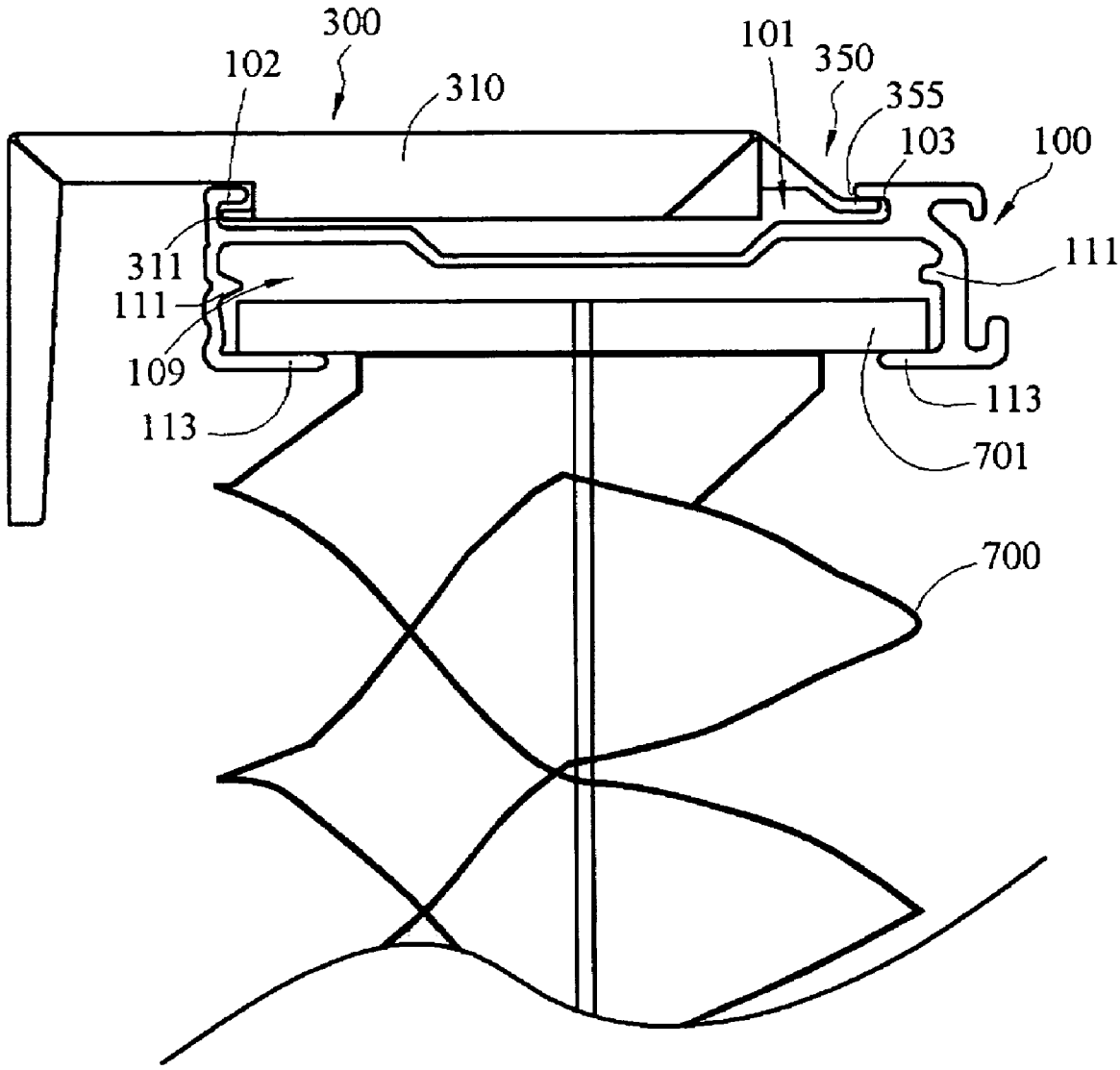

As shown in FIGS. 1A and 1B, they are schematic assembled views of the present invention. The present invention provides a bracket and head rail assembly, wherein the head rail 100 is easily gripped into or detached from the bracket 300. The bracket 300 has a claw 311 at one side and a stopper 355 at the other side, wherein the stopper 355 slides relative to the bracket 300, and thus, it can be stretched out and drawn back. A recess 101 is formed in the upper portion of the head rail 100, and two opposite ends of the recess 101 respectively extend upwardly and inwardly to form a first slot 102 and a second slot 103, wherein the first slot 102 and the second slot 103 have the same shape. During the assembling process, firstly, the second slot 103 is forced to bear against one side of the stopper 355 of the bracket 300 and slide relative to the bracket 300. When the head rail 100 is positioned, the stopper 355 is set back, such that the first slot 102 grips with the claw 311, so as to fix the head rail 100 in the bracket 300. If the head rail 100 is to be detached from the bracket 300, it may be easily detached according to the steps in reversed order.

A cavity 109 is defined by the recess 101 and its two opposite ends respectively extending downwardly and inwardly, and two side walls are formed by the opposite ends of the recess 101 extended downwardly. A first protrusion 111 is protruded on the inside of the side walls respectively protruded opposite inwardly, and a second protrusion 113 is extended inwards from both ends of the side walls respectively. As such, the first protrusions 111 and the second protrusions 113 form a confined space for an insert plate 701 to be inserted. The insert plate 701 may be bonded with a window-covering element, such as a honeycomb pleat 700. As shown in FIG. 1A, a upper portion of the honeycomb pleat 700 is sleeved with the insert plate 701, and then, such a upper portion sleeved with the insert plate 701 is inserted between the first protrusion 111 and the second protrusion 113 for being fixed. Additionally, as shown in FIG. 1B, one upper portion of the honeycomb pleat 700 is adhered to one side surface of the insert plate 701 for being fixed. Then, the insert plate 701 is inserted between the first protrusion 111 and the second protrusion 113 for being fixed.

As known from the above that, for the assembly of the head rail 100 and the bracket 300, a substantially track-shaped slot is formed in the upper portion of the head rail 100 for gripping with the bracket 300, and a cavity is formed in the lower portion of the head rail 100. Therefore, the head rail 100 has a simple structure and it is designed into a highly thinned configuration.

Figure 2:
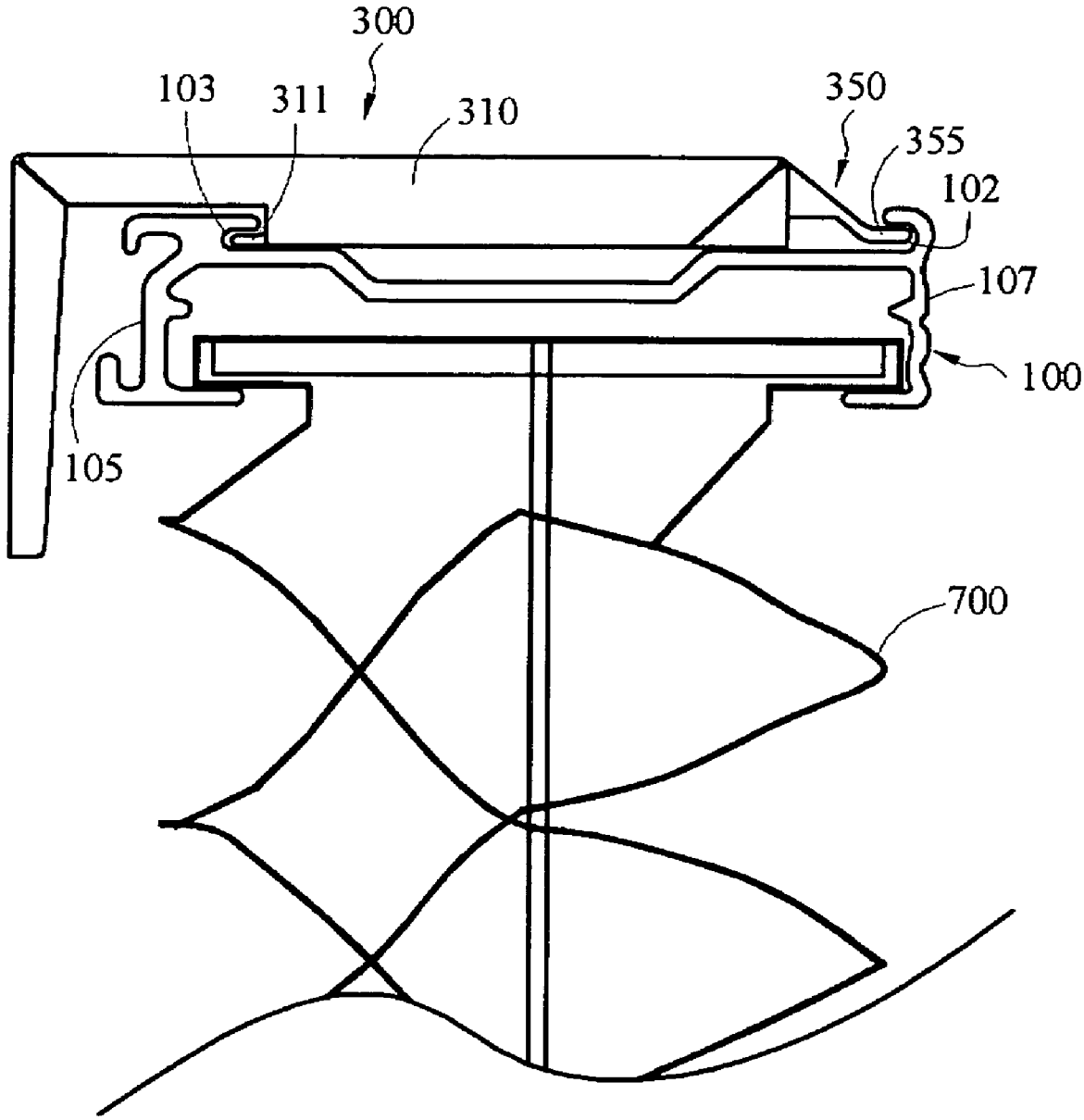
FIG. 2 is a schematic view of another assembling method of the present invention.

Referring to FIG. 2, it is a schematic view of another assembling method of the present invention. As shown in FIGS. 1A and 1B, the position of the head rail 100 indicates that the head rail 100 is assembled with the bracket 300 via the first assembling method. As shown in FIG. 2, the head rail 100 is rotated towards left or right by 180 degrees to indicate another assembling method, which is called the second assembling method. When the head rail 100 is assembled with the bracket 300 via such a method, the first slot 102 firstly bears against the stopper 355 and pushes the stopper 355 to slide relative to the bracket 300. After the head rail 100 is positioned, the stopper 355 is recovered to the original position. The second slot 103 of the head rail 100 grips with the claw 311, such that the head rail 100 is gripped with the bracket 300 and thereby being fixed. As such, the head rail 100 may be assembled with the bracket 300 via the first or second assembling method, and then, different structural aspects and assembling styles are achieved by adopting different exteriors and curve designs of side surfaces 105 and 107 of the head rail 100.

Figure 3:
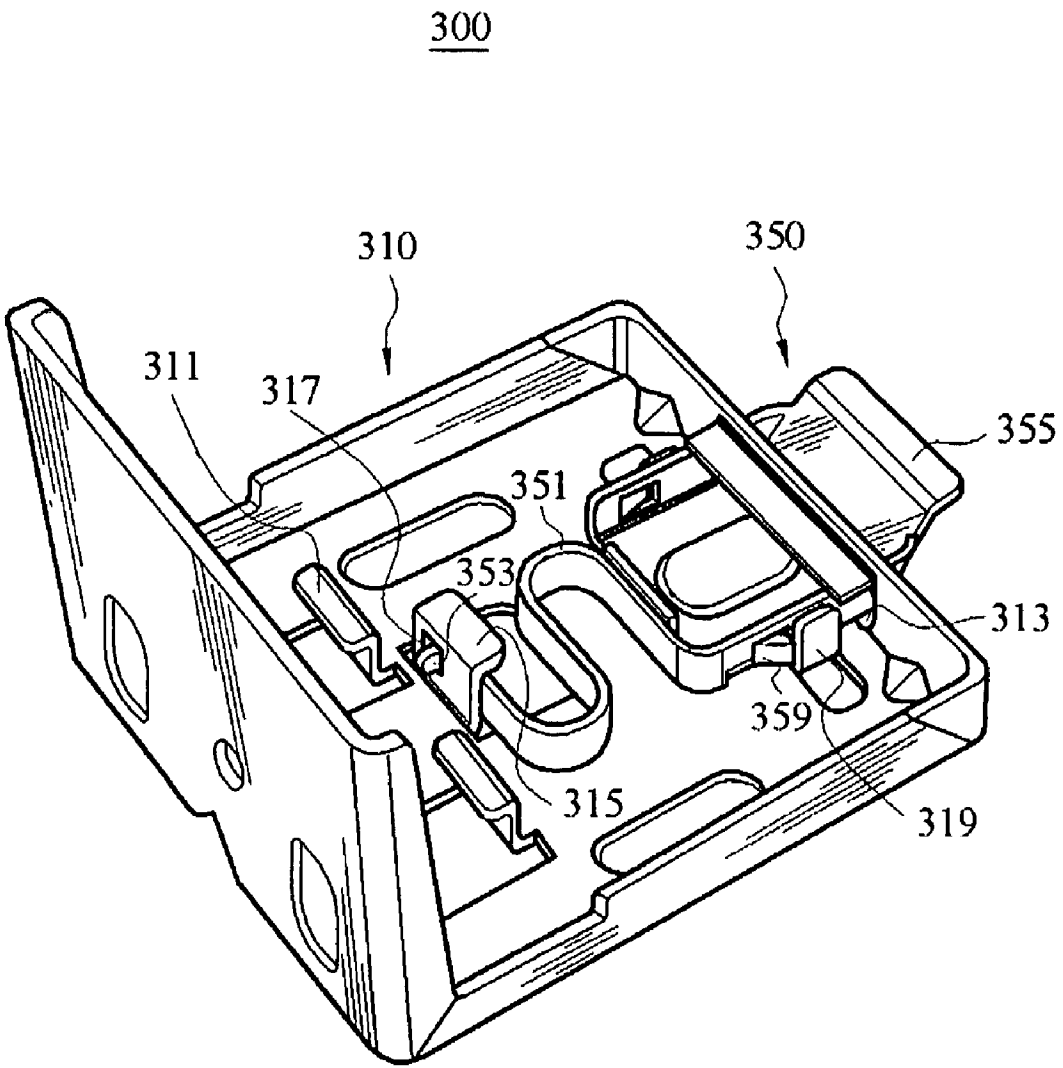
FIG. 3 is a schematic assembled view of a bracket of the present invention.
Figure 4:
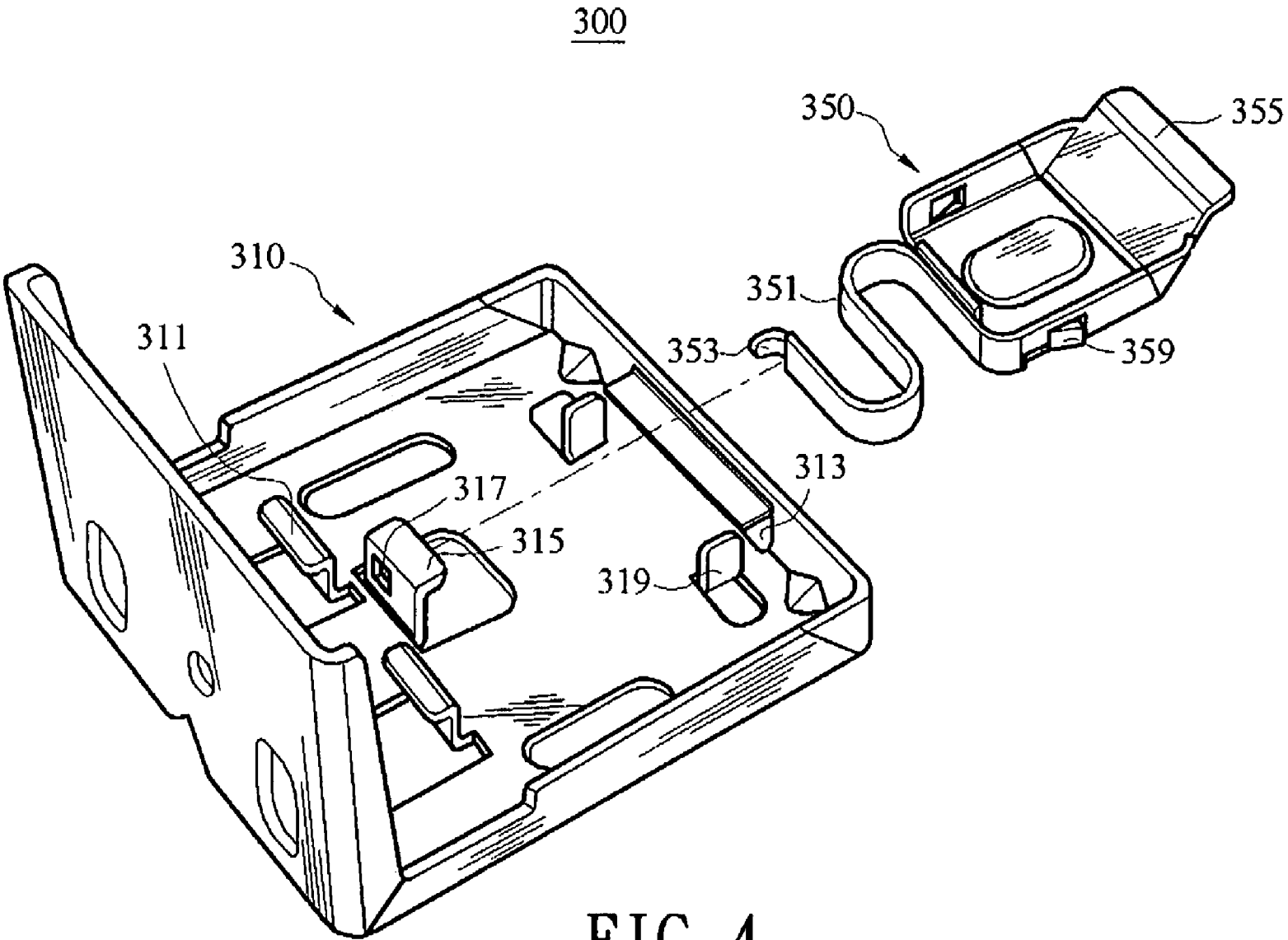
FIG. 4 is an exploded view of the bracket of the present invention.

As shown in FIGS. 3 and 4, they are respectively a schematic assembled view and an exploded view of the bracket of the present invention. As shown in FIGS. 1A, 2, 3, and 4, the bracket 300 includes a body 310 and a fastener 350. A slightly L-shaped claw 311 is extended from one side surface of the body 310 and bears against the first slot 102 or the second slot 103 of the head rail 100. A hole 313 is opened in the other side of the body 310 opposite to the claw 311. A baffle 315 is extended from a position close to the claw 311, and a clipping hole 317 is opened in the baffle 315. An elastic part 351 is extended from one side of the fastener 350. The elastic part 351 is formed by a plate extending from the fastener 350 and bent into S-shaped along the longitudinal direction of the fastener 350. A hook 353 is further formed at one end of the elastic part 351. A stopper 355 is extended from the fastener 350 at the other side corresponding to the elastic part 351 and bears against the first slot 102 (as shown in FIG. 2) or the second slot 103 (as shown in FIG. 1A).

When the fastener 350 is assembled with the body 310, the fastener 350 passes through the hole 313, and the hook 353 of the elastic part 351 bears in the clipping hole 317 of the baffle 315, such that the fastener 350 is slidably disposed in the body 310. In addition, when the fastener 350 is pushed under the elastic force of the elastic part 351, the elastic part 351 is compressed, such that the stopper 355 of the fastener 350 is moved relative to the body 310.

Additionally, a limiting projection 359 is extended at a periphery edge where the fastener 350 contacts with the hole 313, and when the body 310 approaches the hole 313, a spacing projection 319 is extended at the sliding trace around the fastener 350. When the fastener 350 is moved outwards under the elastic force of the elastic part 351, the limiting projection 359 bears against the spacing projection 319, and thereby restricting the position of the stopper 355 of the fastener 350 protruding from the body 310, and further preventing the fastener 350 from dropping off from the body 310.

As known from the above that, the elastic part of the fastener is formed by bending along the longitudinal direction of the fastener, thus, a design of a thin configuration may be achieved. Furthermore, the fastener can be formed by bending a plate, such that the fastener may be manufactured quickly in mass production.

Figure 5:
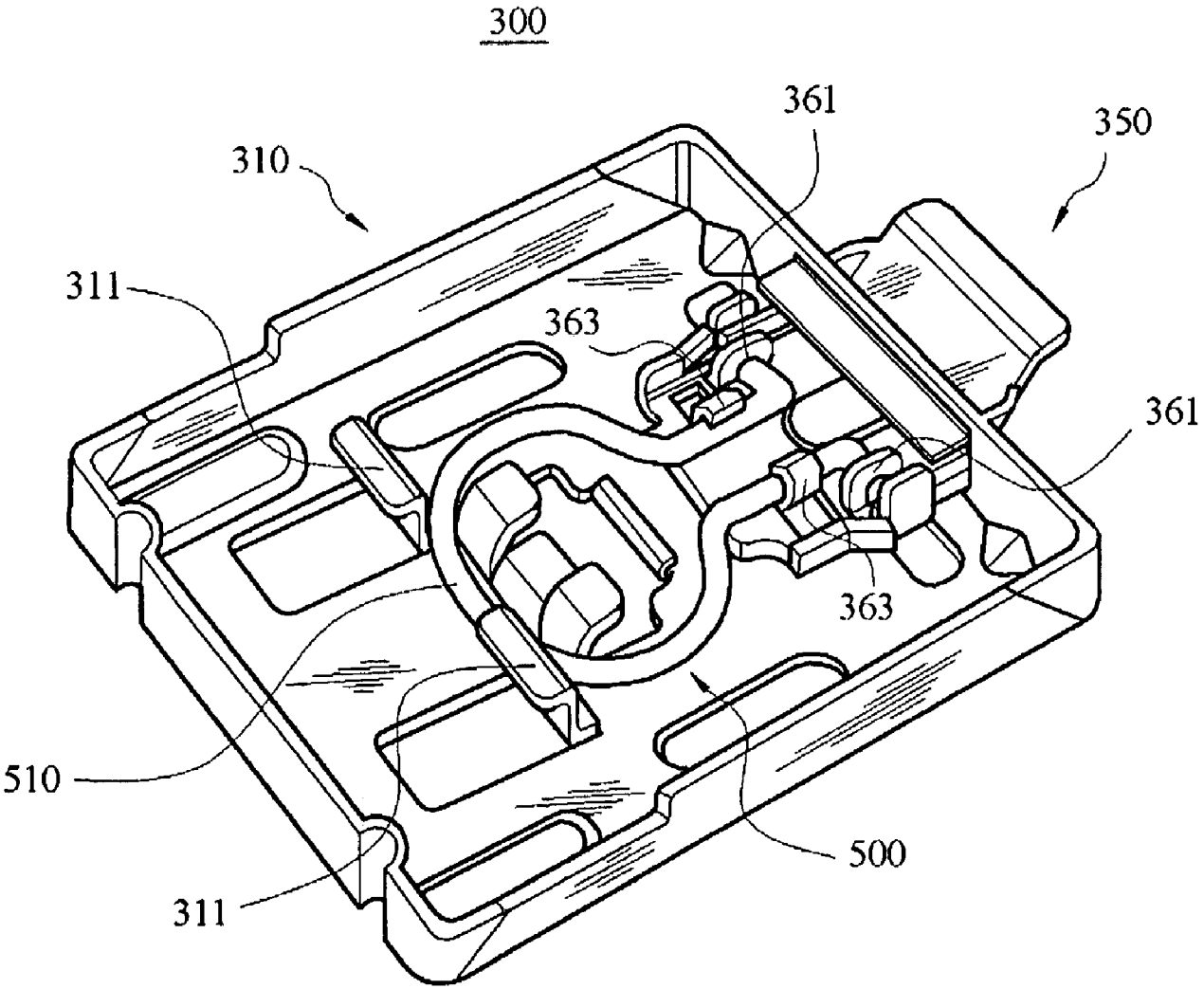
FIG. 5 is a schematic assembled view of a bracket of another embodiment of the present invention.

As shown in FIG. 5, it is a schematic assembled view of a bracket of another embodiment of the present invention. The body 310 is the same as the above-mentioned embodiment; therefore, the body 310 will not be described. The surface in one side of the fastener 350 is protruded to form a pair of locking fasteners 361. The pair of locking fasteners is corresponding to each other. In addition, a pair of protruded fixing portion 363 is set adjacent to the locking fasteners 361. Besides, an elastic element 500 with a curved portion 510 is formed by bending a round metal wire, and the curved portion 510 of the elastic element 500 is against the claws 311 on the body 310. The two ends of the elastic element 500 are fastened to the locking fasteners 361 and the protruded fixing portions 363 constrain the elastic element 500, so as to fix the elastic element 500 on the fastener 350. Therefore, the fastener 350 can be moved any motion relating to the body 310 by the elasticity of the elastic element 500.

Therefore, as for the bracket and head rail assembly provided by the present invention, the head rail is designed into a thin configuration and can be easily fixed or detached from the bracket. Furthermore, the bracket has a simple structure and can be assembled easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bracket and head rail assembly, comprising a bracket and a head rail, the bracket, comprising:

a body, with a claw extended from one side thereof; and a fastener, slidably disposed on the body, wherein a plate is extended from one side of the fastener and is bent along the longitudinal direction of the fastener to form an elastic part, the elastic part bears against the body, and a stopper is extended from the other side of the fastener opposite to the elastic part, wherein said body further comprising a baffle, extending toward the claw and being configured to bear against the elastic part, a clipping hole formed in the baffle, and a hook formed at one end of the elastic part wherein the hook bears against the clipping hole so that the hook is fixed by the clipping hole; and the head rail, with a recess formed in a upper portion of the head rail, wherein a first slot and a second slot are formed respectively at two opposite ends of the recess, and a cavity is defined the recess;

wherein when the head rail is assembled to the bracket, the second slot is selected to bear against the stopper and the first slot bears against the claw, or the first slot is selected to bear against the stopper and the second slot bears against the claw.

2. The bracket and head rail assembly as claimed in claim 1, wherein the body has a hole, such that the fastener passes through the hole and is slidably disposed in the body.

3. The bracket and head rail assembly as claimed in claim 1, wherein a limiting projection is extended from one side of the fastener, a spacing projection is extended from the body, and the limiting projection bears against the spacing projection and defines a position where the stopper protrudes from the body.

4. The bracket and head rail assembly as claimed in claim 1, wherein two opposite sides of the head rail have different exteriors or curve designs.

5. The bracket and head rail assembly as claimed in claim 1, wherein the first slot and the second slot of the head rail have the same shape.

6. The bracket and head rail assembly as claimed in claim 1, further comprising an insert plate, wherein said cavity has two side walls and each of the side walls has a first protrusion formed on the inside of the side wall and a second protrusion formed at one end of the side walls, the insert plate being inserted between the first and second protrusions so that the insert plate is fixed therebetween.

7. The bracket and head rail assembly as claimed in claim 6, further comprising a window-covering element with one end bonded with the insert plate.

8. The bracket and head rail assembly as claimed in claim 1, wherein the elastic part is formed by bending the plate along the longitudinal direction of the fastener into an S shape, and thereby being elastic.

* * * * *